US006723002B1

(12) United States Patent
Barlow

(10) Patent No.: US 6,723,002 B1
(45) Date of Patent: Apr. 20, 2004

(54) GOLF PUTTER WITH OFFSET SHAFT

(76) Inventor: David R. Barlow, 7620 Harborview Way N., Seminole, FL (US) 33776

( * ) Notice: Subject to any disclaimer, the term of this patent is extended or adjusted under 35 U.S.C. 154(b) by 0 days.

(21) Appl. No.: 10/349,463

(22) Filed: Jan. 22, 2003

(51) Int. Cl.[7] ..... A63B 53/04

(52) U.S. Cl. ..... 473/252; 473/314; 473/341; 473/342

(58) Field of Search ..... 473/313, 314, 473/340, 341, 342, 252

(56) References Cited

U.S. PATENT DOCUMENTS 1,631,504 A * 6/1927 Redman
3,549,300 A * 12/1970 Pelz
4,411,429 A * 10/1983 Drew et al.
5,409,220 A * 4/1995 Lombardo
5,454,564 A * 10/1995 Kronogard
5,573,468 A * 11/1996 Baumann
5,728,009 A * 3/1998 Shanahan
5,749,793 A * 5/1998 Lucetti
5,755,625 A * 5/1998 Jackson
6,152,832 A * 11/2000 Chandler, III
6,488,595 B1 * 12/2002 Grace

* cited by examiner

*Primary Examiner*—Stephen Blau
(74) *Attorney, Agent, or Firm*—Larson & Larson. PA; James E. Larson

(57) ABSTRACT

A golf putter has a flat ball-striking surface at a right angle from a top and bottom surface of the main blade. The top surface has an irregular back edge and a straight front edge interfacing with the ball-striking surface. The bottom surface extends beyond the back edge of the top surface in a semi-circular pattern and also has a straight front edge interfacing with the ball-striking surface. A shaft penetrates the top surface at a left portion looking from the ball-striking surface. The shaft is bent at a distance of one to four inches above the top surface of the blade and the bend is ten to twenty degrees toward the blade top surface.

12 Claims, 6 Drawing Sheets

GOLF PUTTER WITH OFFSET SHAFT

BACKGROUND OF THE INVENTION

This invention relates to a golf putter. More particularly, it refers to a golf putter having a striking blade top surface with a shaft entering the top surface distal from a golfer bent over the putter.

A golf putter is one of the most important clubs in a golfer's bag. On most standard length eighteen hole golf course par is 72. Two strokes for each hole using a golf putter is common for most golfers. This constitutes one half of the strokes if per 72 is to be achieved. Professional golfers rarely need 36 putts to complete a round, but even professionals use at least one-third of their total strokes as putts. For this reason, golfers who have a desire to improve their golf score looks to his/her putter as a key ingredient to a better score. Most golfers own numerous golf putters including those with extended shafts and shafts bent at various angles. In the final analysis, a golfer's best putter is one which is well balanced, has sufficient means to control the direction of the struck golf ball and can assist the golfer in lining up the golf ball with the hole. The search continues for a more perfect putter.

SUMMARY OF THE INVENTION

This invention provides an improved golf putter having outstanding balance, adequate means to control the direction of golf ball movement and providing a line of sight from the golf blade striking surface to the hole that is an improvement over standard golf putters.

This improved golf putter has a flat ball striking surface perpendicular to a substantially planar top and bottom surface of the putter blade. The front edge of the top and bottom surface are straight on the ball-striking surface. The back edge of the top surface is irregular in shape and the bottom surface extends rearwardly beyond the top surface in a semi-circular pattern.

A shaft enters the top surface at a left portion looking from the ball striking surface. The shaft is bent towards the top surface at a distance to one to four inches above the top surface. The bend is about ten to twenty degrees. This permits a golfer grasping an end of the shaft to look downwardly above the ball-striking surface.

BRIEF DESCRIPTION OF THE DRAWINGS

The invention can be best understood by those having ordinary skill in the art be reference to the following detailed description when considered in conjunction with the accompanying drawings in which.

DETAILED DESCRIPTION OF THE BEST MODE

Figure 1:
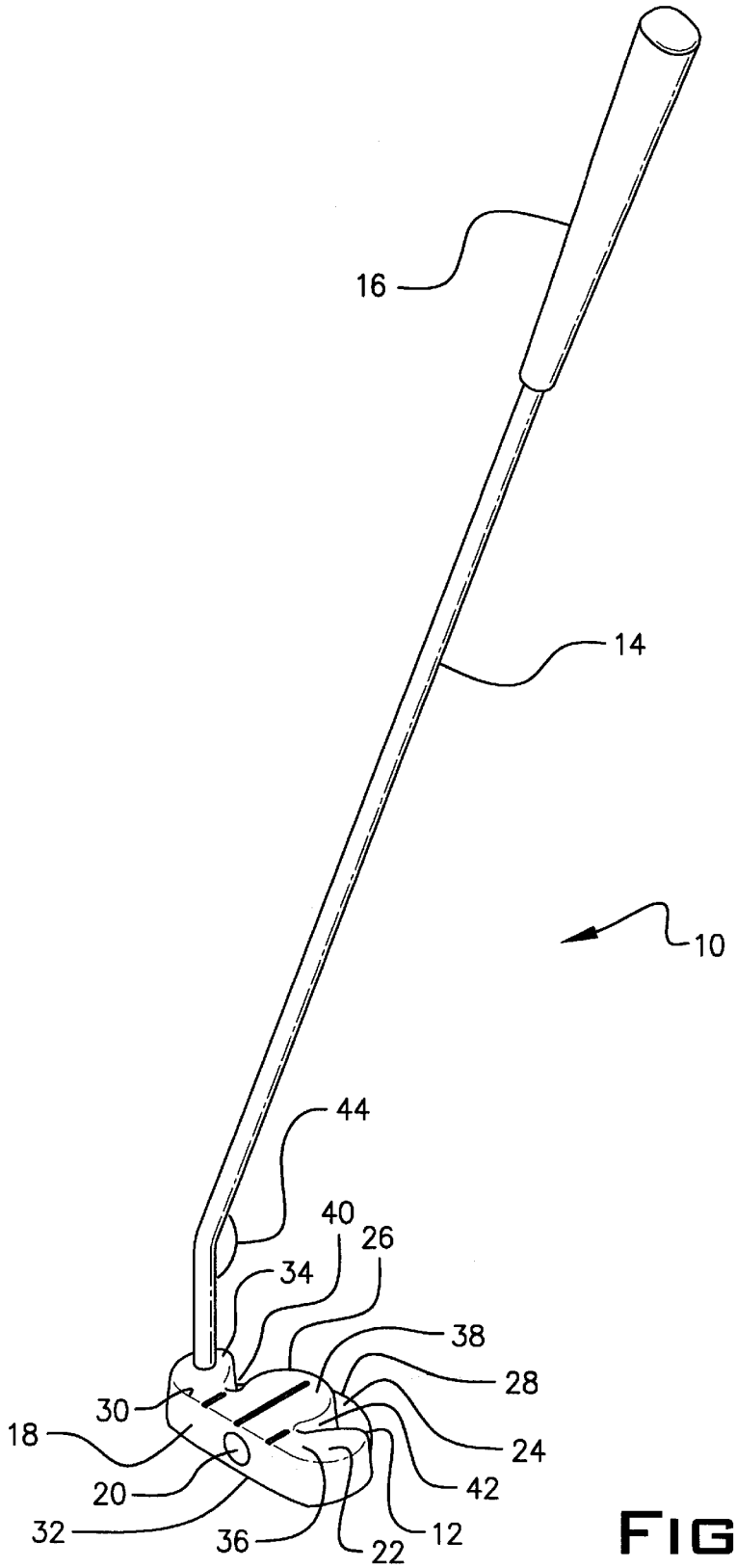
FIG. 1 is a perspective view of the golf putter of this invention.

Throughout the following detailed description, the same reference numerals refer to the same elements in all figures.

The golf putter 10 of this invention as shown in FIG. 1 has a blade 12, a shaft 14 and a grip 16. The blade 12 has a flat front striking-surface 18 with a weight insert 20. A top surface 22 and bottom surface 24 are substantial flat or planar over and under the ball-striking portion of the blade, with the top surface 22 having an irregular back edge 26 and the bottom surface 24 having a semi-circular back edge 28. The front edge 30 of top surface 24 and a front edge 32 of bottom surface 24 interface with the ball-striking surface 18. Right and left side portions of the bottom surface 24 are chamfered.

The top surface 22, looking from the ball-striking surface 18, has a left 34 and right 36 backward protruding portion and a middle 38 backward protruding portion with spaces 40 and 42 separating the left and right protruding portions respectfully front the middle portion 38.

Middle portion 38 has the same diameter as a golf ball 46 and parallel lines 56 and 58 in top surface 22 are separated by the diameter of a golf ball. Line 60 bisects middle portion 38 and provides the line of sight to the hole.

The shaft 14 penetrates top surface 22 at left portion 34. At one to four inches above top surface 22 shaft 14 bends 44 at an angle of ten to twenty degrees. The angle of bend 44 is toward the blade top surface 22 so that a golfer 48 can grasp grip 16 and look downwardly at the top surface 22 and golf ball 46. Preferably the bend is about three inches above top surface 22 and the bend angle is about fifteen degrees.

Figure 2:
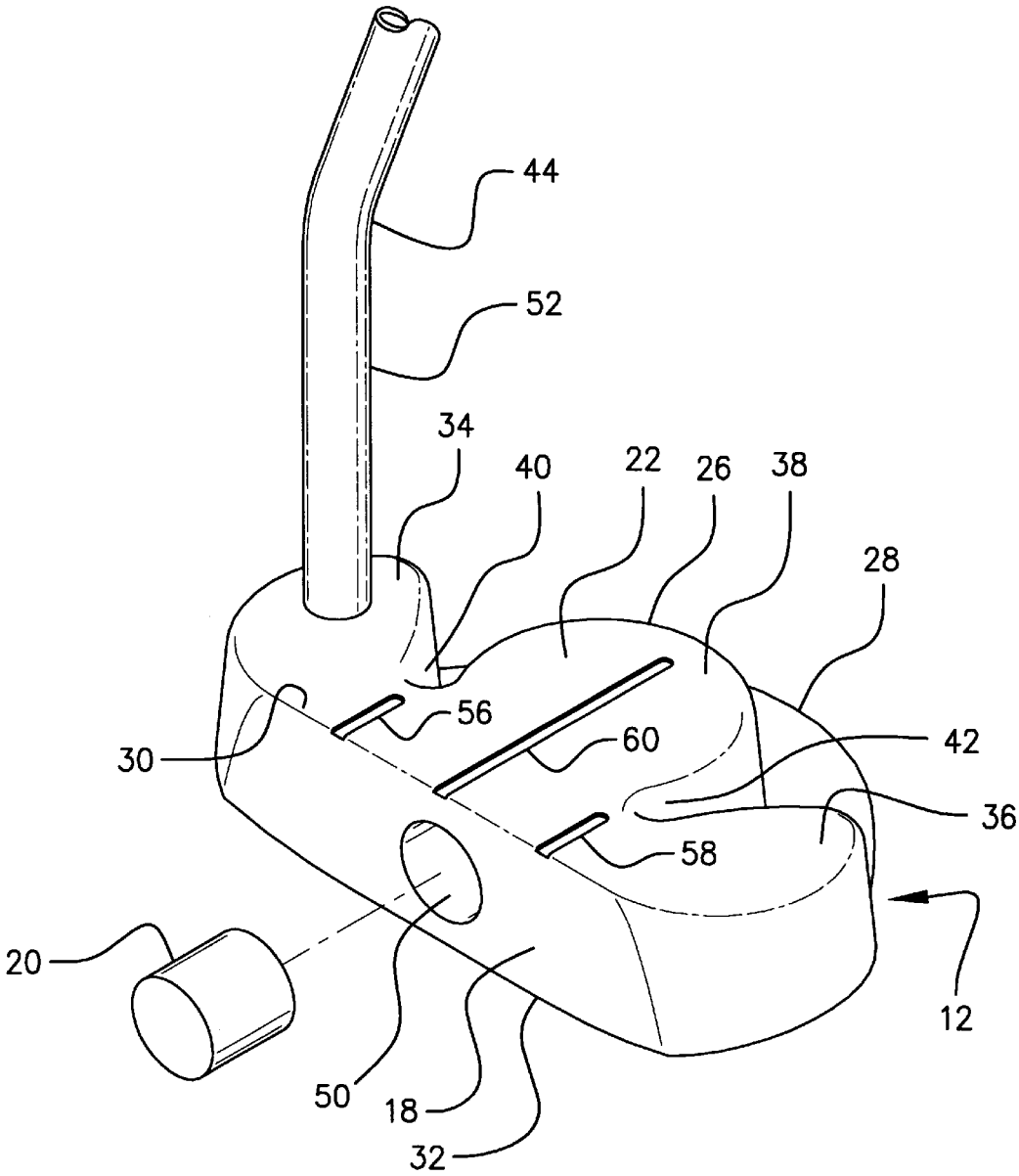
FIG. 2 is a closeup perspective front view of the golf blade portion showing a weight insert and the bent shaft.
Figure 3:
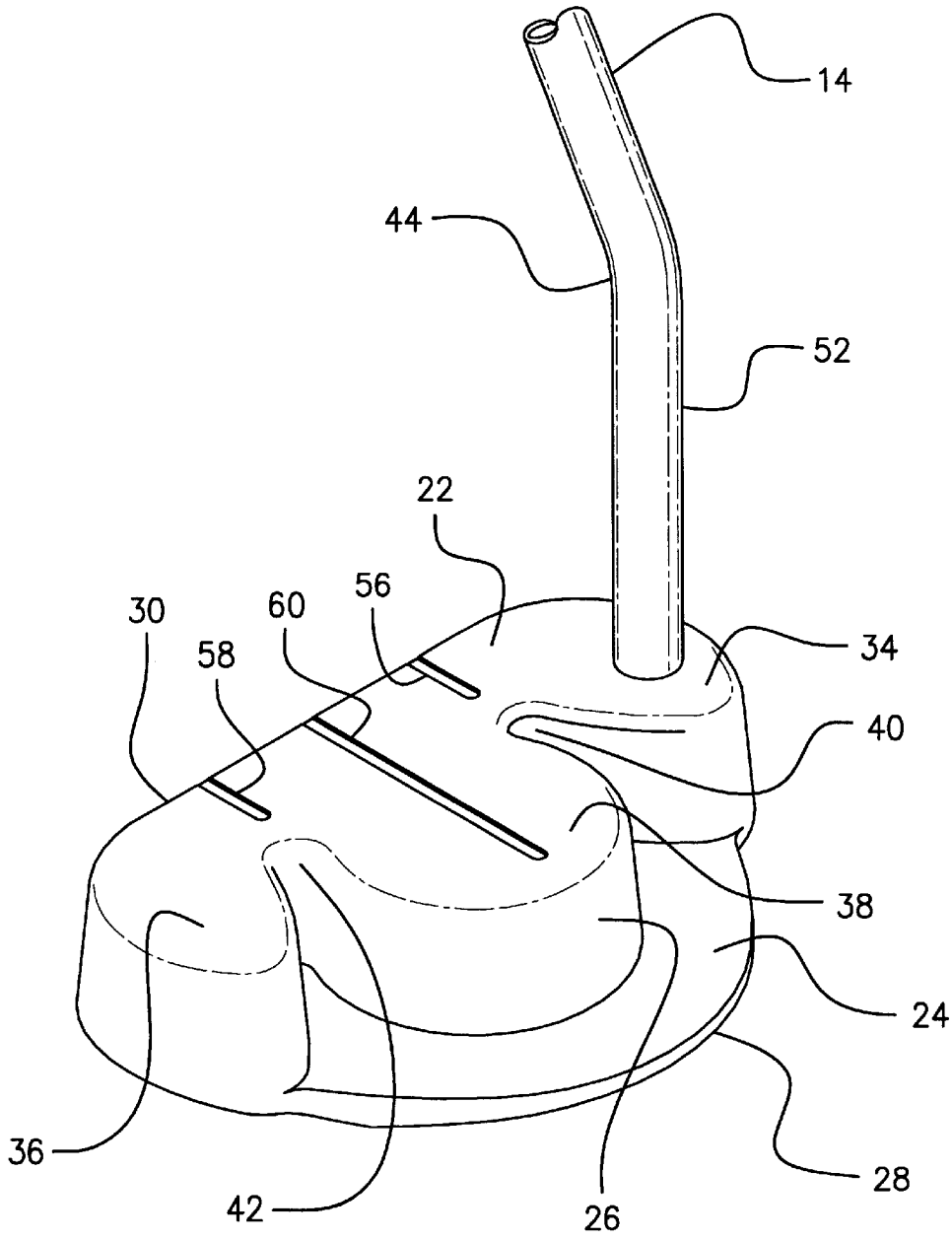
FIG. 3 is a closeup perspective back view of the golf blade with bent shaft.
Figure 4:
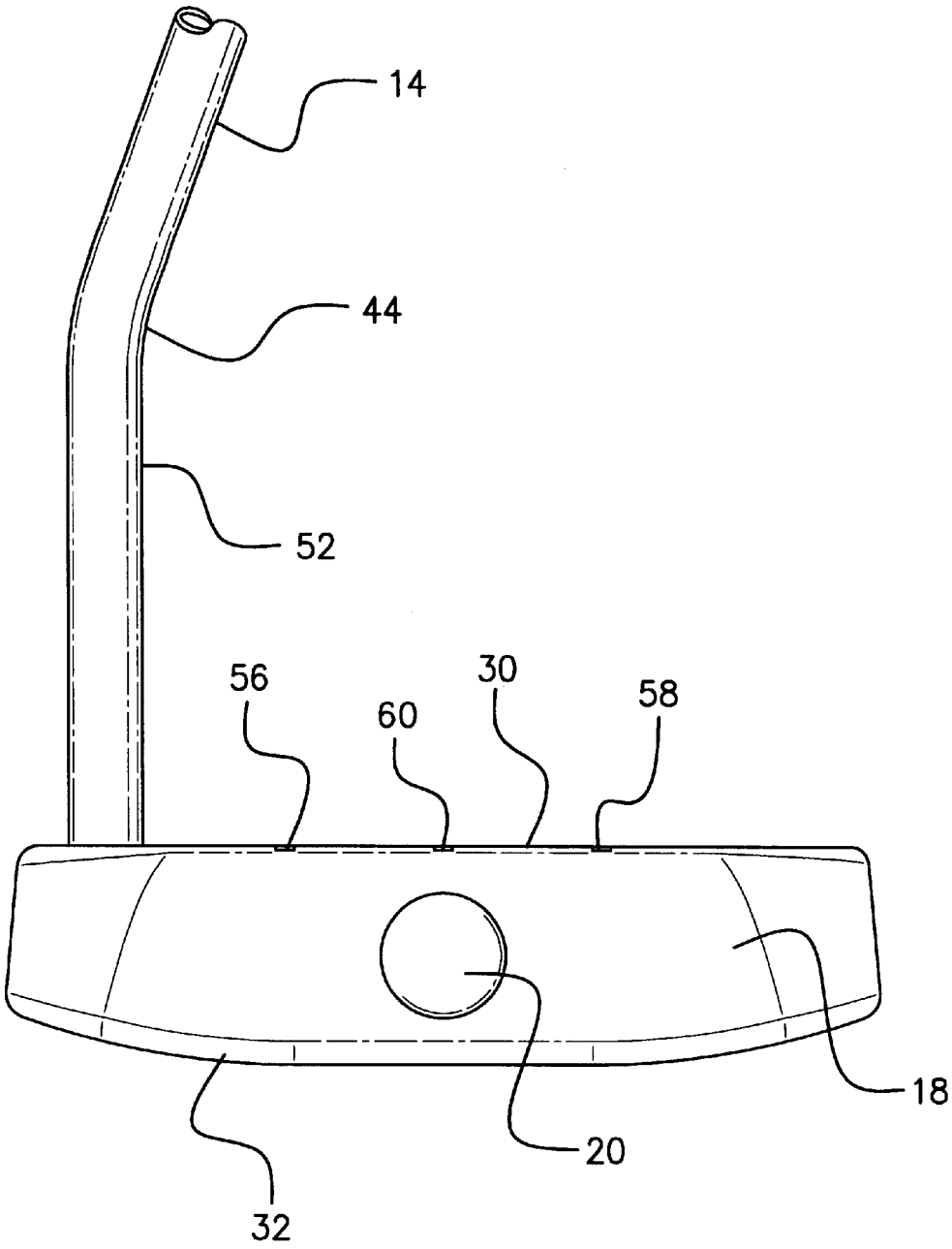
FIG. 4 is a front elevational view of the golf blade and bent shaft.

FIG. 2 shows the weight insert 20 about to be inserted in hole 50 in blade 12 front surface 18. The insert 20 is glued in hole 50. The insert can be copper or other material including a polymer that is different from the steel, aluminum or titanium material of the blade 12. The portion 52 of shaft 14 below the bend is one to four inches long.

Figure 5:
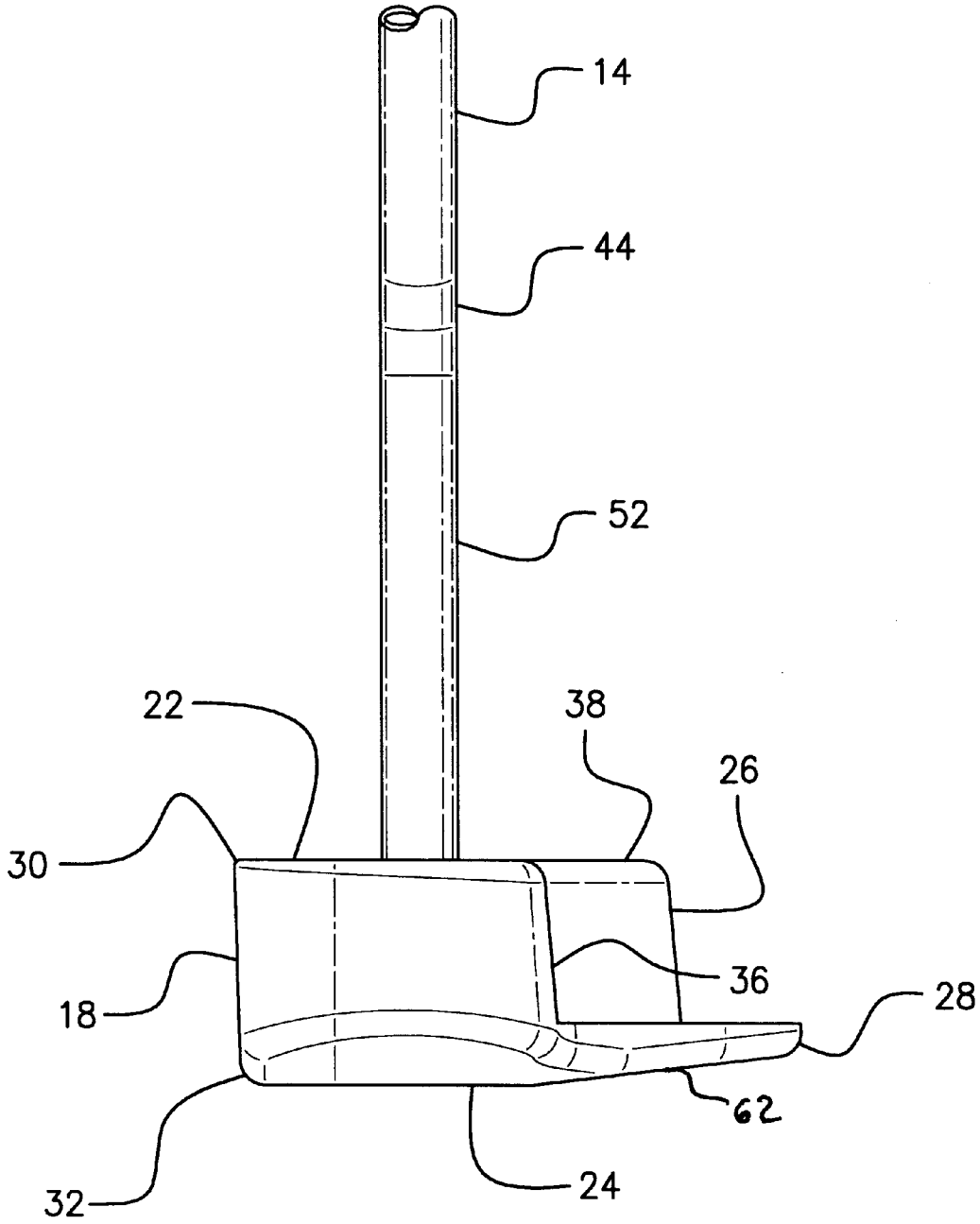
FIG. 5 is a side elevational view opposite the side of the blade nearest the shaft.

The front edge 32 of bottom surface 24 is chamfered as seen in FIG. 5 and the back portion is slanted upwardly towards back edge 28 to provide for a smooth forward swing of putter 10.

Figure 6:
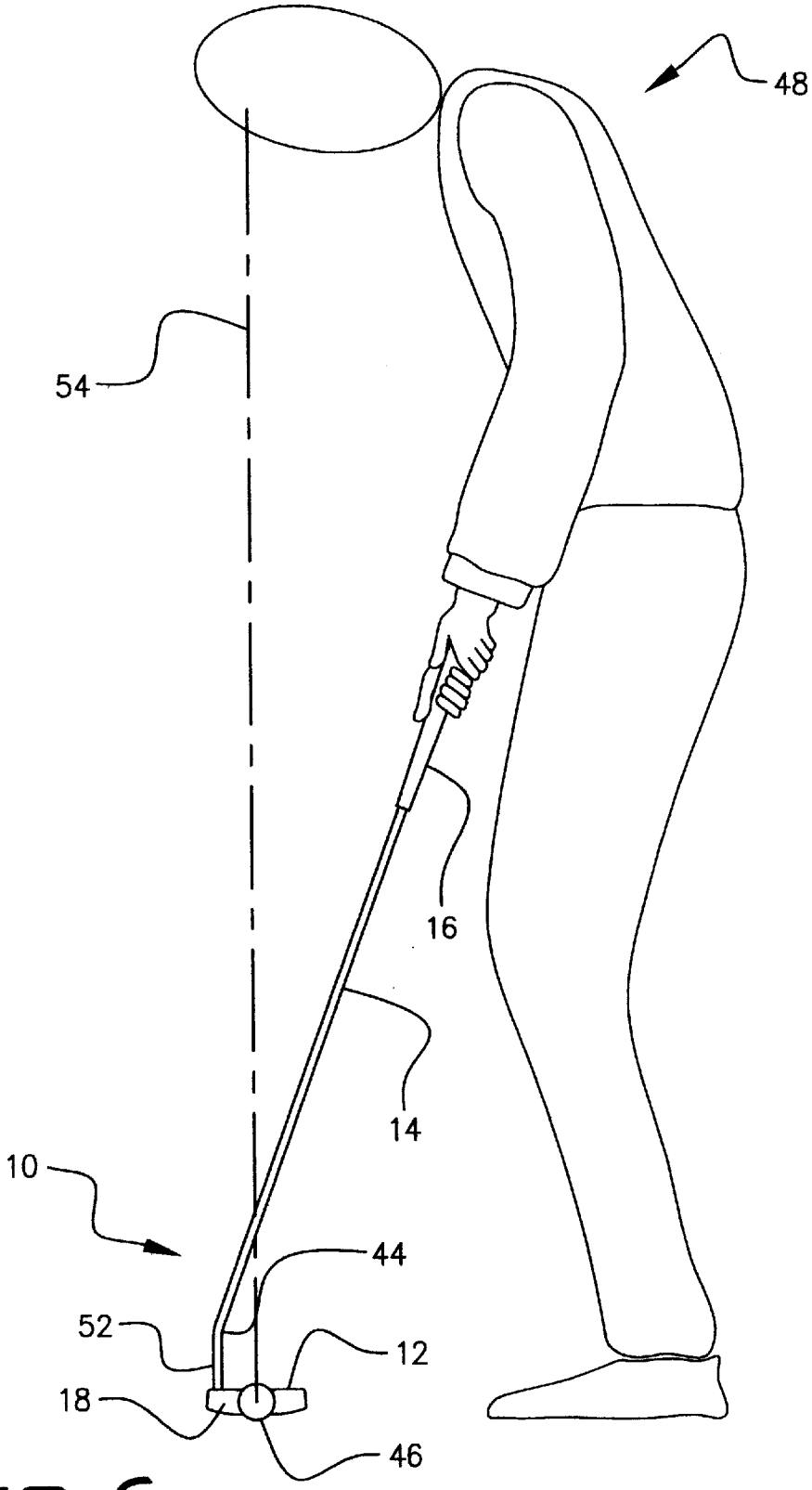
FIG. 6 is a side elevational view of a golfer addressing a golf ball employing the golf putter of this invention.

In lining up golf ball 46, the golfer 48 has a line of sight 54 directly over the ball 46 as shown in FIG. 6. The putter is positioned with respect to golf ball 46 so that lines 56 and 58 on top surface 22 are on each side of the golf ball 46 before striking.

The golf putter 10 is balanced so that golfer 48 can hold the shaft 14 in one hand and the blade 12 is perpendicular to the ground. The grip 16 is lightly held and the blade will drop behind the ball 46 perpendicular to the ball's line of travel. A slight movement of the blade 12 lines the ball 46 between lines 56 and 58. Once the golfer 48 has his/her line to the hole, the ball is truck and the results enjoyed. The center of balance of golf putter 10 with the blade resting perpendicular to the earth creates a smooth pendulum swing motion.

Other equivalent components can be substituted for the components employed in the golf putter 10 to have substantially the same function, in substantially the same way and create substantially the same result.

What is claimed is:

1. A golf putter comprising:

a putter blade with a flat ball-striking surface and a main body disposed in trailing relation to the ball-striking surface;

the main body having a top surface and a bottom surface, both having a straight front edge interfacing with the ball-striking surface;

the top surface viewed from the ball-striking surface having a right and left rearward protruding solid body and a middle rearward protruding solid body spaced apart on a right and left side from the right and left rearward protruding solid bodies;

the middle rearward protruding solid body having a side to side diameter equivalent to the diameter of a golf ball;

a putting shaft inserted into a bore in the left rearward protruding solid body top surface, the shaft bent at an angle of ten to twenty degrees at one to four inches above the top surface, the shaft inclined over the middle and right solid body so that a golfer gripping an end of the shaft distal from the putter blade has his/her eyes directly over the putter blade and a golf ball when striking the golf ball.

2. A golf putter according to claim 1 wherein a right and a left side end portion of the bottom surface is chamfered.

3. A golf putter according to claim 1 wherein the putter blade ball-striking surface has an insert of dissimilar material from a remainder of the ball-striking surface.

4. A golf putter according to claim 1 wherein a back edge of the bottom surface is in the form of a hemisphere.

5. A golf putter according to claim 1 wherein the shaft is bent at an angle of about fifteen degrees.

6. A golf putter according to claim 1 wherein the shaft is bent about three inches above the top surface of the blade.

7. A golf putter according to claim 1 wherein a rear portion of the bottom surface protrudes rearwardly from the rearward protruding solid body.

8. A golf putter having a blade and a shaft portion, the putter comprising:

the blade having a flat ball-striking surface and a rearwardly projecting main body, the main body having a top surface, a bottom surface and a right and left side surface;

the top surface viewed from the ball-striking surface having a right, middle and left rearward protruding solid body, each solid body partially spaced apart, the middle solid body having a side to side diameter equivalent to the diameter of a golf ball;

the shaft inserted perpendicularly into a bore in the left solid body, the shaft bent towards the middle and right solid body at an angle of ten to twenty degrees about one to four inches above a top surface of the left solid body;

the shaft having a grip portion distal from the left solid body, the grip capable of being grasped by a golfer so that a head of the golfer is positioned above the ball-striking surface and a golf ball tangent to the ball-striking surface.

9. The golf putter according to claim 8 wherein the top surface has a straight front edge above the ball-striking surface and an irregular back edge.

10. The golf putter according to claim 8 wherein the bottom surface has a straight front edge below the ball-striking surface and has a hemispheral rear configuration extending beyond an irregular back edge of the top surface.

11. The golf putter according to claim 8 wherein a rear portion of the bottom surface slants upwardly towards a rear edge.

12. The golf putter according to claim 8 wherein the shaft is bent about fifteen degrees at a portion of the shaft about three inches above the top surface of the left rearward protruding solid body.

* * * * *